US007374439B2

(12) United States Patent
Kodama et al.

(10) Patent No.: US 7,374,439 B2
(45) Date of Patent: May 20, 2008

(54) CARD CONNECTOR

(75) Inventors: Hiromitsu (William) Kodama, Kanagawa (JP); Max Chao, Taipei (TW)

(73) Assignees: Tyco Electronics AMP K.K, Kanagawa-Ken (JP); Tyco Holding (Bermuda) No. 7 Ltd., Pembroke (BM)

( * ) Notice: Subject to any disclaimer, the term of this patent is extended or adjusted under 35 U.S.C. 154(b) by 30 days.

(21) Appl. No.: 11/383,648

(22) Filed: May 16, 2006

(65) Prior Publication Data

US 2006/0256536 A1 Nov. 16, 2006

(30) Foreign Application Priority Data

May 16, 2005 (TW) ..... 94207877 U

(51) Int. Cl.
*H01R 13/44* (2006.01)

(52) U.S. Cl. ..... 439/138

(58) Field of Classification Search ..... 439/138, 439/137, 142

See application file for complete search history.

(56) References Cited

U.S. PATENT DOCUMENTS 6,135,802 A * 10/2000 Nakamura ..... 439/352
7,025,609 B2 * 4/2006 Matsumoto et al. ..... 439/138
7,097,475 B2 * 8/2006 Cheng ..... 439/138

FOREIGN PATENT DOCUMENTS

JP 2006079843 3/2006

* cited by examiner

*Primary Examiner*—Javaid H. Nasri
(74) *Attorney, Agent, or Firm*—Barley Snyder LLC

(57) ABSTRACT

The invention comprises a top board with a plurality of buckling portions, each of two sides of the top board has a bearing hole, a sustaining frame connected with the top board, a spring hole provided in one side of the top board, a cover with an arc rim, two end portions of the cover pivotably mounted in bearing holes of the top board, and a spring connected with the spring hole of top board and providing an elasticity to the cover. The side of the sustaining frame corresponding to the arc rim has a stop projection extending therefrom, the cover corresponding to the stop projection has a receiving notch cooperating with the stop projection to stop the cover when forced to pivot. One side of receiving notch in the cover near the sustaining frame has a flange extending therefrom upwards toward the vertical card-inserting direction. The top of the flange is horizontal for further cooperating with stop projection when the cover is forced to pivot.

5 Claims, 6 Drawing Sheets

CARD CONNECTOR

FIELD OF THE INVENTION

The present invention relates to a card connector, and more particularly to a card connector for preventing cover damage.

BACKGROUND

The Personal Computer Memory Card International Association (PCMCIA) is a memory card standard for the interface between a computer and a computer peripheral product. A PCMCIA card (briefly referred to PC card) is an integrated circuit (IC) card that conforms to the PCMCIA standard, and a PCMCIA slot is a slot that conforms this standard. PC cards are widely used for connecting computers and computer peripheral devices. Especially for notebook computers, external peripheral devices are required due to the small size of a notebook computer, and PC cards therefore become an optimum interface. Presently, PC cards mainly act as data transmitting or local network cards for notebook computers, in order to eliminate the user's trouble for carrying heavy peripheral devices.

In order to provide more a superior transporting interface, the PCMCIA developed an express card which is lighter, faster, thinner, easier to use, and applies for more extensive I/O mode than traditional PC cards. The express card has two standards, one is express card/34 having a 34 mm width (small card) and the other is express card/54 having a 54 mm width (big card).

In general, when inserting into a card connector, the express card is positioned in the slot of the card connector and pushed inward to the top of the slot. During insertion, the user has to aim the express card at the opening of card connector carefully thus making a quick insertion difficult. FIG. 7, FIG. 8, and FIG. 9 respectively show a top view of a known card connector, a top view of a known top board, and the cross-section view of A-A line in FIG. 8. When inserting the card (the direction shown by the arrow "a" in FIG. 7 and FIG. 8), if the user can not precisely aim the card at the right position of cover 2 of the card connector (the center of the cover 2), the cover 2 will be undesirably urged and bent in the card-inserting direction "a", and can be easily damaged. For example the cover 2 can be damaged such that it separates from the card connector.

SUMMARY

An object of the invention is to provide a card connector, which provides a stop projection in one side of the card connector to prevent the cover from being deformed and damaged.

The invention comprises a top board with a plurality of buckling portions, each of two sides of the top board has a bearing hole, a sustaining frame connected with the top board, a spring hole provided in one side of the top board, a cover with an arc rim, two end portions of the cover pivotably mounted in bearing holes of the top board, and a spring connected with the spring hole of top board and providing an elasticity to the cover. The side of the sustaining frame corresponding to the arc rim has a stop projection extending therefrom, the cover corresponding to the stop projection has a receiving notch cooperating with the stop projection to stop the cover when forced to pivot.

One side of receiving notch in the cover near the sustaining frame has a flange extending therefrom upwards toward the vertical card-inserting direction. The top of the flange is horizontal for further cooperating with stop projection when the cover is forced to pivot.

DETAILED DESCRIPTION OF THE EMBODIMENTS

Although the present invention will be described in considerable detail with reference to certain embodiments thereof, it is should to be understood that those skilled in the art can easily make changes to the present invention described herein and the same performance as the present invention is obtained. Therefore, it is to be understood that the following description is a general disclosure to those skilled in the art and is not restrictive of the present invention.

Figure 1:
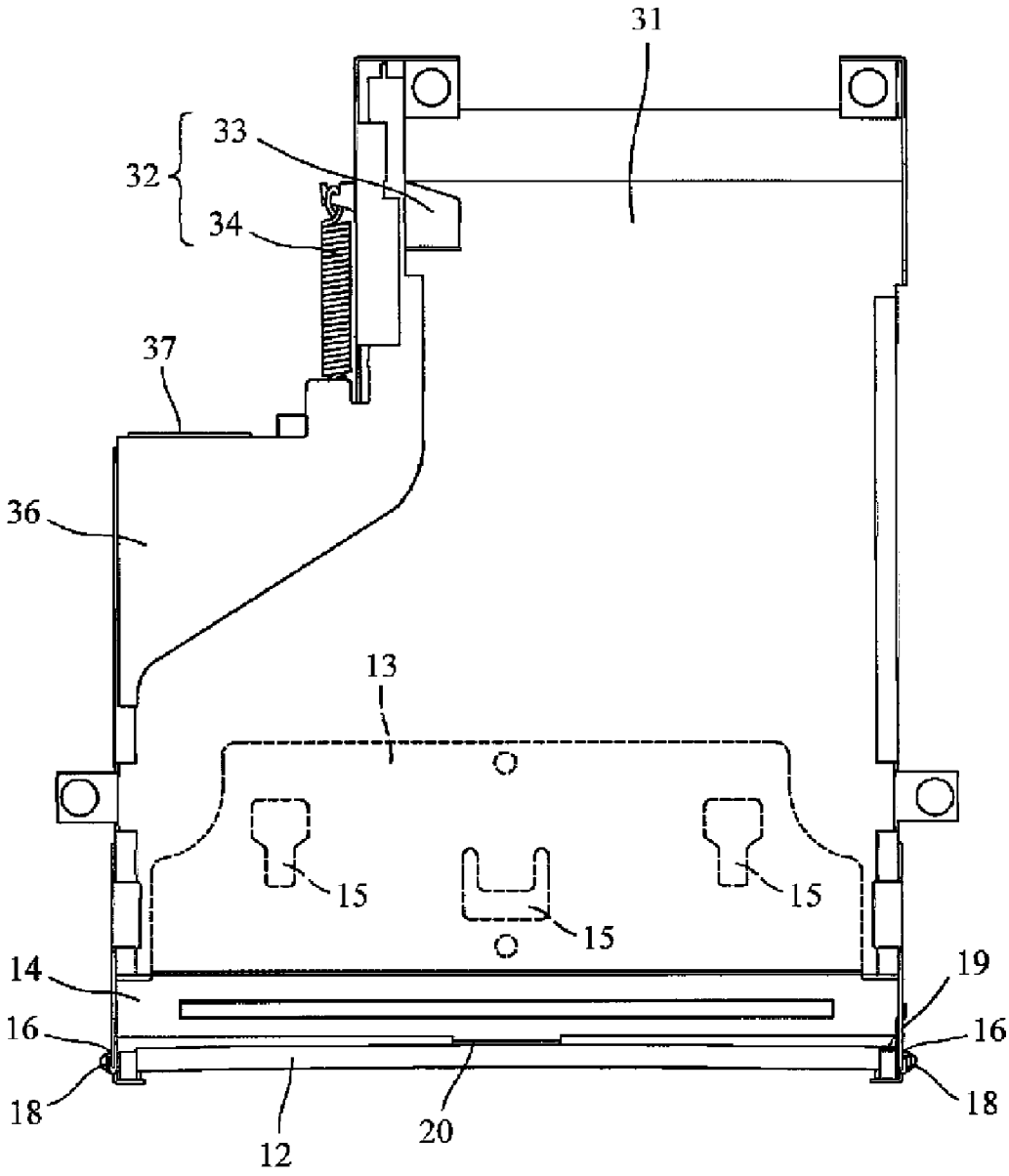
FIG. 1 is a top view of a card connector according to an embodiment of invention.
Figure 2:
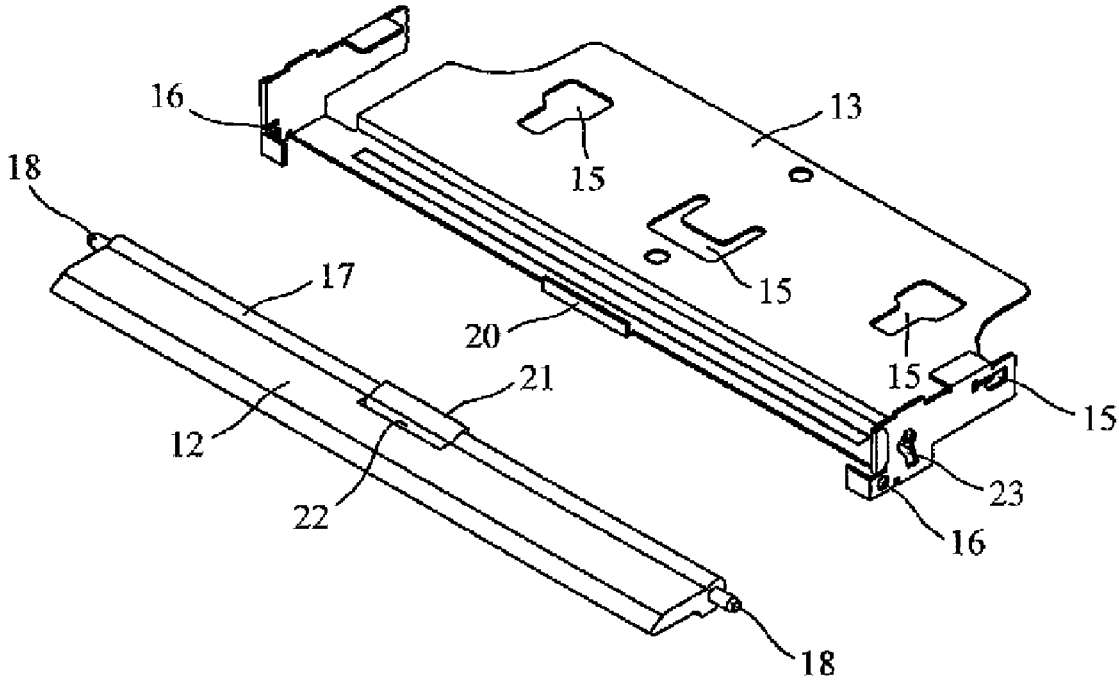
FIG. 2 is an exploded perspective view of the top board and the cover.
Figure 3:
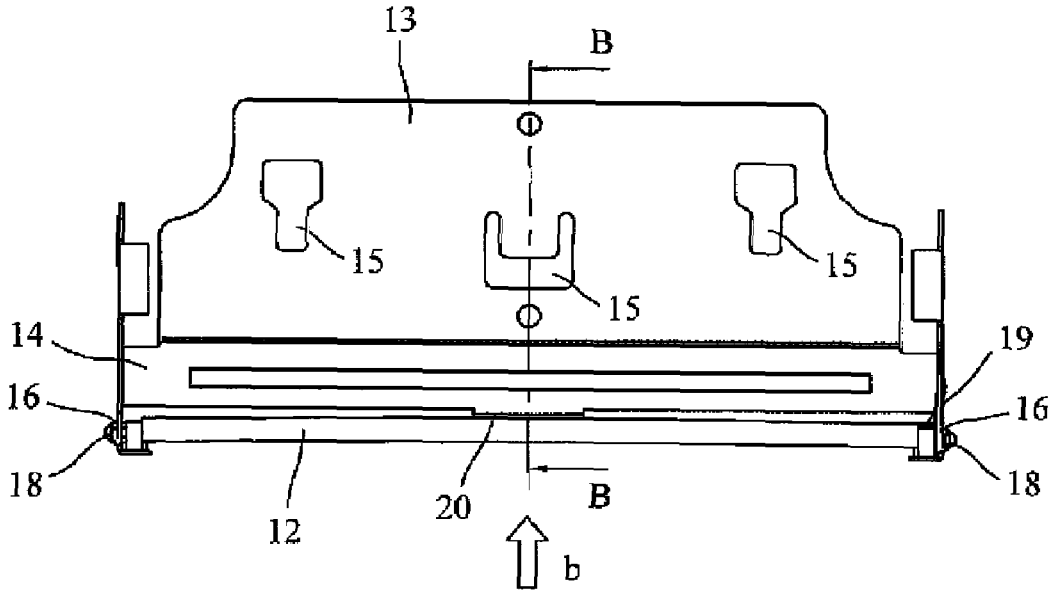
FIG. 3 is a top view of the top board.

Referring to FIGS. 1-3, the card connector of the present invention includes a body 31, having a composite slot structure forming a shoulder portion 37 on the top of the body 31; a pushing device 32, which is provided on one side over the shoulder portion 37. The pushing device 32 has a pushing projection 33 and a spring 34. A retaining board 36, which is triangular is provided in the shoulder portion 37 of the body 31 to guide the card-inserting and to position the card in the card connector. A top board 13, has a sustaining frame 14, a spring hole 23, and a plurality of buckling portions 15. Each of the two sides of the top board 13 has a bearing hole 16. A cover 12 has an arc rim 17 on one side and the two end projections 18 pivotably mount within the bearing holes 16 of top board 13. A spring 19, is connected with a spring hole 23 of the top board 13 and the cover 12.

The top board 13 connects to the body 31 by the plurality of buckling portions 15. The spring 19 provides elasticity to the cover 12 to make the cover 12 pivot. The sustaining frame 14 includes a stop projection 20 in the center. A receiving notch 22 corresponds to the stop projection 20 to cooperate with the stop projection 20 to stop the cover 12 when it is forced to pivot. In addition, one side of receiving notch 22 in the cover 12 near the sustaining frame 14 has a flange 21 extending upwards toward the vertical card-inserting direction. The top of the flange 21 is horizontal and for further cooperating with the stop projection 20 when the cover 12 is forced to pivot.

When an express card (not shown) touches the cover 12 following the direction as shown in arrow "b" in FIG. 3, if the express card moves toward the upper side of the cover 12, then the stop projection 20 will contact with the flange 21 and stop the express card from moving forward. Thus the stop projection 20 provides protection to prevent the cover 12 from being deformed and damaged due to an excessive force, and also reminds users of adjusting the direction of the express card insertion.

Figure 4:
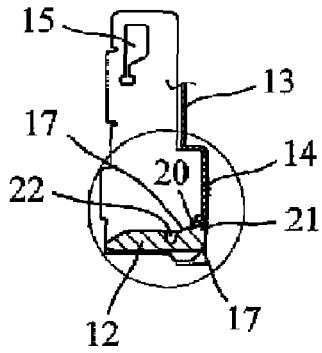
FIG. 4 is a cross-sectional view taken along the line B-B line in FIG. 3.
Figure 5:
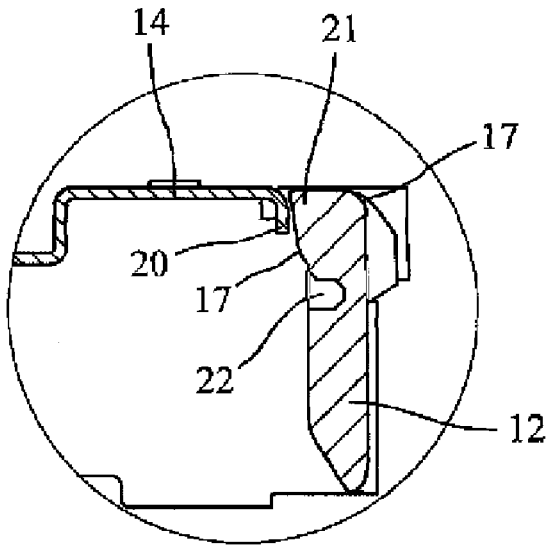
FIG. 5 is an enlarged view of the circled portion in FIG. 4.
Figure 6:
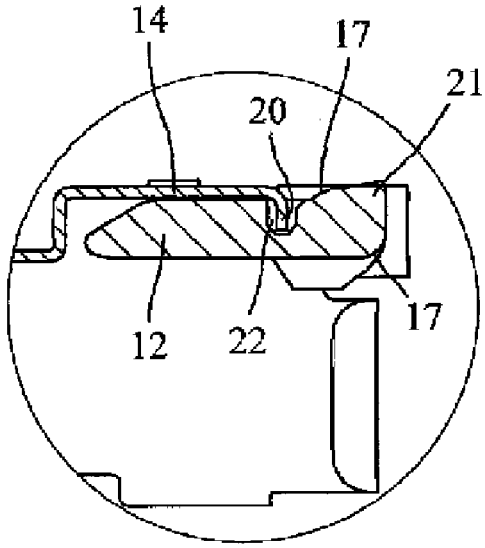
FIG. 6 is a view similar to that of FIG. 5 wherein the cover has been pivoted.
Figure 7:
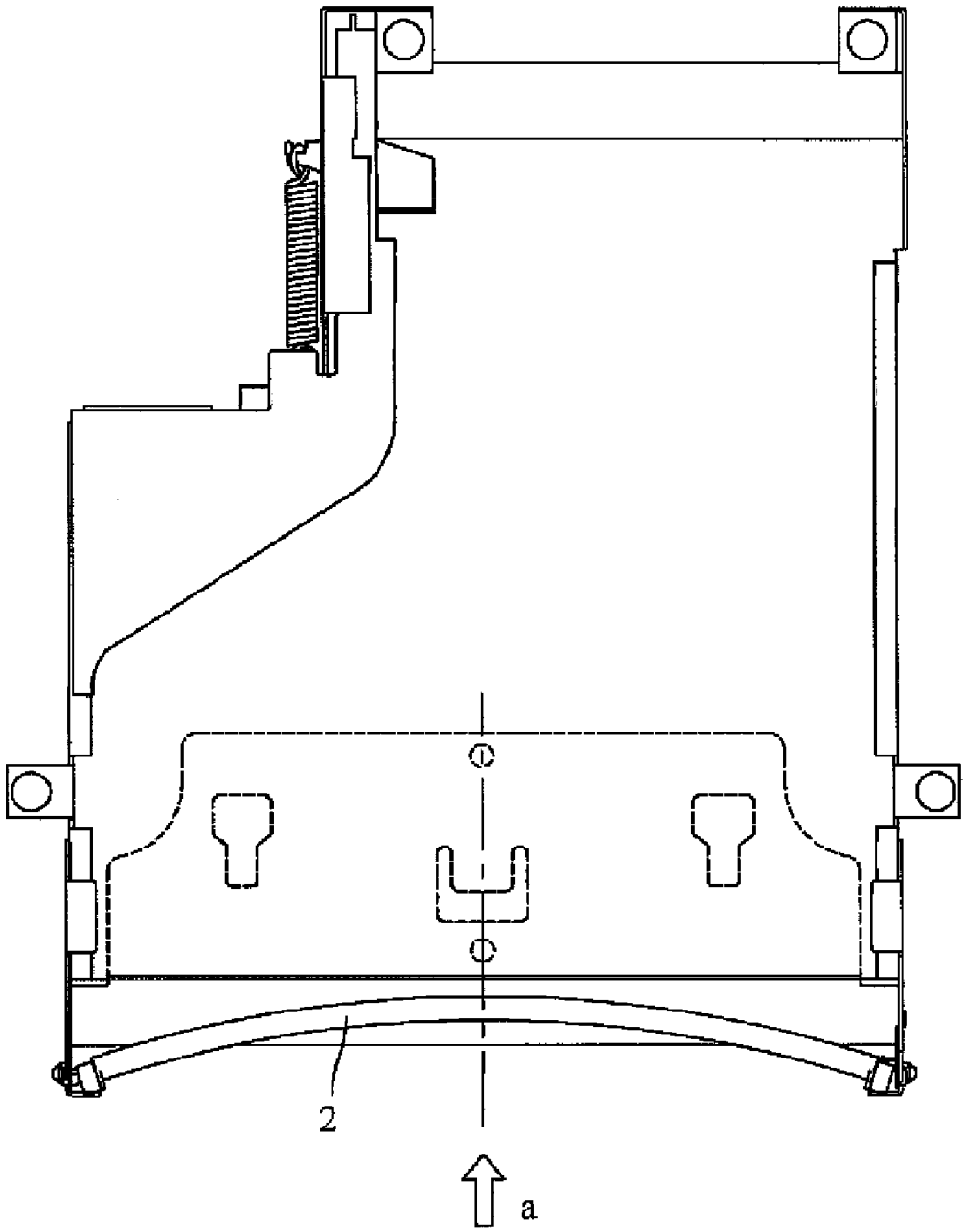
Prior Art Fig. 7
FIG. 7 is a top view of a known card connector.
Figure 8:
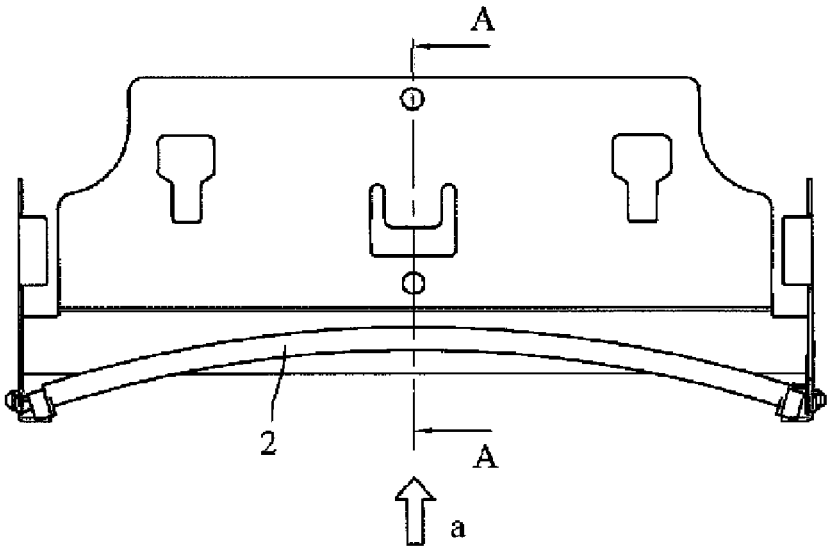
Fig. 8 Prior Art
FIG. 8 is a top view of a known top board.
Figure 9:
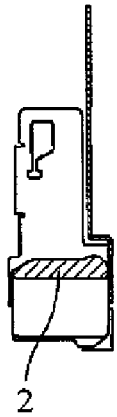
Prior Art Fig. 9
FIG. 9 is a cross-sectional view taken along the line A-A of FIG. 8.

FIG. 5 and FIG. 6 respectively show an enlarged view of the circle in FIG. 4, and a diagram after the cover 12 in FIG. 5 has pivoted. After the cover 12 pivots clockwise by 90 degrees, the receiving notch 22 can receive the stop projection 20 to help the express card go through the cover to connect with a card connector.

Although the present invention has been described in considerable detail with reference to certain embodiments thereof, those skilled in the art can easily understand that alterations and changes can be made within the spirit and scope of the appended claims. Therefore, the spirit and scope of the appended claims should not be limited to the description of the embodiments contained herein.

What is claimed is:

1. A card connector, comprising:

a top board with a plurality of buckling portions, each of two sides of said top board having a bearing hole;

a sustaining frame connected with said top board;

a spring hole provided in one side of said top board;

a cover with an arc rim, two end portions of said cover being pivotably mounted in said bearing holes of said top board; and a spring connected with said spring hole of said top board and providing elasticity to said cover;

one side of said sustaining frame corresponding to said arc rim having a stop projection, said cover corresponding to said stop projection having a receiving notch cooperating with said stop projection to stop said cover when it is forced to pivot.

2. The card connector as claimed in claim 1, further comprising a flange extending upwards from one side of said receiving notch in the cover near the sustaining frame toward a vertical card-inserting direction.

3. A card connector, comprising:

a body;

a pushing device provided in one side of said body, said pushing device includes a pushing projection and a spring;

a retaining board provided in a shoulder portion of said body;

a top board connected to another side of said body, said top board includes a sustaining frame and a spring hole, and each of two sides of said top board has a bearing hole;

a cover with an arc rim, two end portions of said cover being pivotably mounted in said bearing holes of said top board; and a spring, connected to said spring hole of said top board providing elasticity to said cover;

one side of said sustaining frame corresponding to said arc rim having a stop projection, said cover corresponding to said stop projection has a receiving notch cooperating with said stop projection to stop said cover when forced to pivot.

4. The card connector as claimed in claim 3, further comprising a flange extending upwards from one side of said receiving notch in the cover near the sustaining frame toward a vertical card-inserting direction.

5. The card connector as claimed in claim 3, wherein said top board has a plurality of buckling portions to buckle said body.

* * * * *